US008110759B2

(12) United States Patent
Flegel

(10) Patent No.: US 8,110,759 B2
(45) **Date of Patent: *Feb. 7, 2012**

(54) ELECTRICAL PANEL INPUT INTERLOCK ASSEMBLY

(75) Inventor: Michael O. Flegel, Racine, WI (US)

(73) Assignee: Reliance Controls Corporation, Racine, WI (US)

( * ) Notice: Subject to any disclaimer, the term of this patent is extended or adjusted under 35 U.S.C. 154(b) by 451 days.

This patent is subject to a terminal disclaimer.

(21) Appl. No.: 12/463,717

(22) Filed: May 11, 2009

(65) Prior Publication Data

US 2010/0187075 A1 Jul. 29, 2010

Related U.S. Application Data

(63) Continuation-in-part of application No. 11/759,063, filed on Jun. 6, 2007, now Pat. No. 7,531,762.

(60) Provisional application No. 60/804,016, filed on Jun. 6, 2006.

(51) Int. Cl.
*H01H 9/26* (2006.01)

(52) U.S. Cl. ..... 200/50.32; 200/50.33

(58) Field of Classification Search ..... 200/50.32, 200/50.33, 50.37–50.39, 50.4; 361/622, 361/624, 631

See application file for complete search history.

(56) References Cited

U.S. PATENT DOCUMENTS

| | | | | |
|---|---|---|---|---|
| 4,270,031 | A | 5/1981 | Borona et al. | |
| 5,204,803 | A | 4/1993 | Runge | |
| 5,648,646 | A | 7/1997 | Flegel | |
| 5,805,414 | A | 9/1998 | Feldhaeusser | |
| 5,835,341 | A | 11/1998 | Rhodes et al. | |
| 6,031,193 | A | 2/2000 | Flegel | |
| 6,096,986 | A | 8/2000 | Flegel | |
| 6,184,595 | B1 | 2/2001 | Flegel | |
| 6,521,849 | B1 | 2/2003 | Flegel | |
| 6,621,689 | B1 | 9/2003 | Flegel | |
| 6,927,349 | B1 | 8/2005 | Flegel et al. | |
| 7,402,766 | B1 | 7/2008 | Jonas et al. | |
| 7,446,270 | B2 | 11/2008 | Somalingayya et al. | |
| 7,462,791 | B1 * | 12/2008 | Flegel | 200/50.32 |
| 7,531,762 | B2 * | 5/2009 | Flegel | 200/50.32 |

OTHER PUBLICATIONS

"Main Lugs Generator Panel", Schneider Electric, www.Schneider-electric.ca/www/en/products/stab-lok/html/lugsgenerator.htm, Mar. 26, 2004, 3 pages.

* cited by examiner

*Primary Examiner* — Xuong Chung Trans

(74) *Attorney, Agent, or Firm* — Boyle Fredrickson, S.C.

(57) ABSTRACT

A system and method of interlocking a plurality of electrical panel switches includes an interlock assembly having an interlock. The interlock has a first position that allows connection of one of primary power and power from an alternate power supply, such as a generator, to the electrical panel and prevents connection of the other of the primary power and alternate power. The interlock has a second position that allows connection of the other of the primary power and alternate power and prevents connection of one of the primary power and alternate power to the electrical panel. The interlock also is constructed to control the positioning and sequence of operation of neutral connections between the power supplies and the electrical panel.

16 Claims, 16 Drawing Sheets

ELECTRICAL PANEL INPUT INTERLOCK ASSEMBLY

CROSS-REFERENCE TO RELATED APPLICATION

This application is a continuation-in-part of U.S. Ser. No. 11/759,063, filed Jun. 6, 2007 now U.S. Pat. No. 7,531,762 and now allowed, which claims the benefit of U.S. Ser. No. 60/804,016, filed Jun. 6, 2006, the disclosures of which are incorporated herein by reference.

BACKGROUND OF THE INVENTION

The present invention relates generally to electrical panels and, more particularly, to a power supply or input interlock assembly constructed to electrically isolate different inputs connected to an electrical panel.

Electrical panels, breaker boxes, or load centers frequently include a main contactor, switch, or breaker, which electrically isolates a series of load breakers from a primary or utility power input. Occasionally, such load panels are configured to receive another input power source, such as from a generator, to provide electrical power to the individual loads in the event of a primary power failure. During interruption of primary power, the generator supplies power to the load center, which the load center distributes to the selected or designated circuits of the building. Before activating the generator power supply, the main switch must be disconnected or turned "OFF" to prevent the generator power from backfeeding through the primary power supply conductors. A user must manually configure the switches of the load center to electrically connect the generator power with the series of loads and electrically isolate the primary power from the generator power, and vice-versa. In order to maintain electrical isolation between the generator power input and the primary power input, the connection/disconnection of the primary power supply and generator power supply must be performed in a specific sequence to ensure electrical isolation of the respective input powers. An interlock system has been developed for carrying out this function, and is shown and described in Flegel U.S. Pat. No. 6,621,689 issued Sep. 16, 2003, the disclosure of which is hereby incorporated by reference. While the system shown in the '689 patent controls operation of a main power supply ON/OFF switch and an auxiliary power supply ON/OFF switch, it contains no provisions for controlling operation of neutral switches associated with the main and auxiliary power supplies.

When a bonded neutral generator is connected to the wiring system of a building, the grounding conductor and the neutral conductor are connected in two places within the system. This allows for the return of current back to the generator to flow on both the grounding conductor and on the neutral conductor. Having normal current flow on the grounding conductor limits the ability of the grounding conductor to perform its safety function, and is therefore undesirable. Switching the neutral conductor(s) when switching the power supply conductors prevents any neutral current from flowing on the grounding conductor. Furthermore, it is important to control the sequence of operation of the generator and primary power supply neutral switches when switching between power sources, since supplying power to a device without a neutral may result in failure of the device due to an unpredictable voltage being supplied to the device. To prevent this occurrence, the switching sequence is as follows when switching from main primary power to generator power:

1. Turn off main power;

2. Turn off main neutral;
3. Turn on generator neutral;
4. Turn on generator power.

This sequence is reversed when switching from generator power to primary power.

For the above reasons, it is desirable to provide an input interlock assembly that ensures electrical isolation of the primary power and the generator power during a transfer of the input power from one source to another, and which controls the sequence of operation of neutral switches associated with the primary and generator power supplies.

SUMMARY OF THE INVENTION

The present invention is directed to a main power switch interlock assembly that prevents inadvertent simultaneous electrical connection of both a primary or utility power input and an input from an alternate power supply, such as a generator, to a breaker panel, and controls actuation of primary and alternate power supply neutral switches.

A system and method of controlling operation of a plurality of electrical panel switches includes an assembly having an interlock. The interlock has a first position that allows power to be supplied to the electrical panel from one power source, such as primary power or an alternate power supply such as a generator, and prevents the supply of power to the electrical panel from the other power source. The interlock also includes a feature that controls movement of neutral switches associated with the alternate power supply and primary power inputs to ensure that the neutral connection of the alternate power supply is ON when the alternate power supply is activated, and that the alternate power supply neutral connection is OFF and the primary neutral is ON when the primary power supply is activated.

Various other features, objects and advantages of the present invention will be made apparent from the following detailed description of the drawing figures.

BRIEF DESCRIPTION OF THE DRAWINGS

The drawings illustrate one preferred embodiment presently contemplated for carrying out the present invention.

In the drawings:

FIG. 11 is an elevational view of the load center assembly shown in FIG. 10 with the switches and interlock assembly positioned such that alternate power is communicated to the load terminal bars and the primary power supply neutral OFF and the alternate power supply neutral ON;

DETAILED DESCRIPTION OF THE PREFERRED EMBODIMENT

Figure 1:
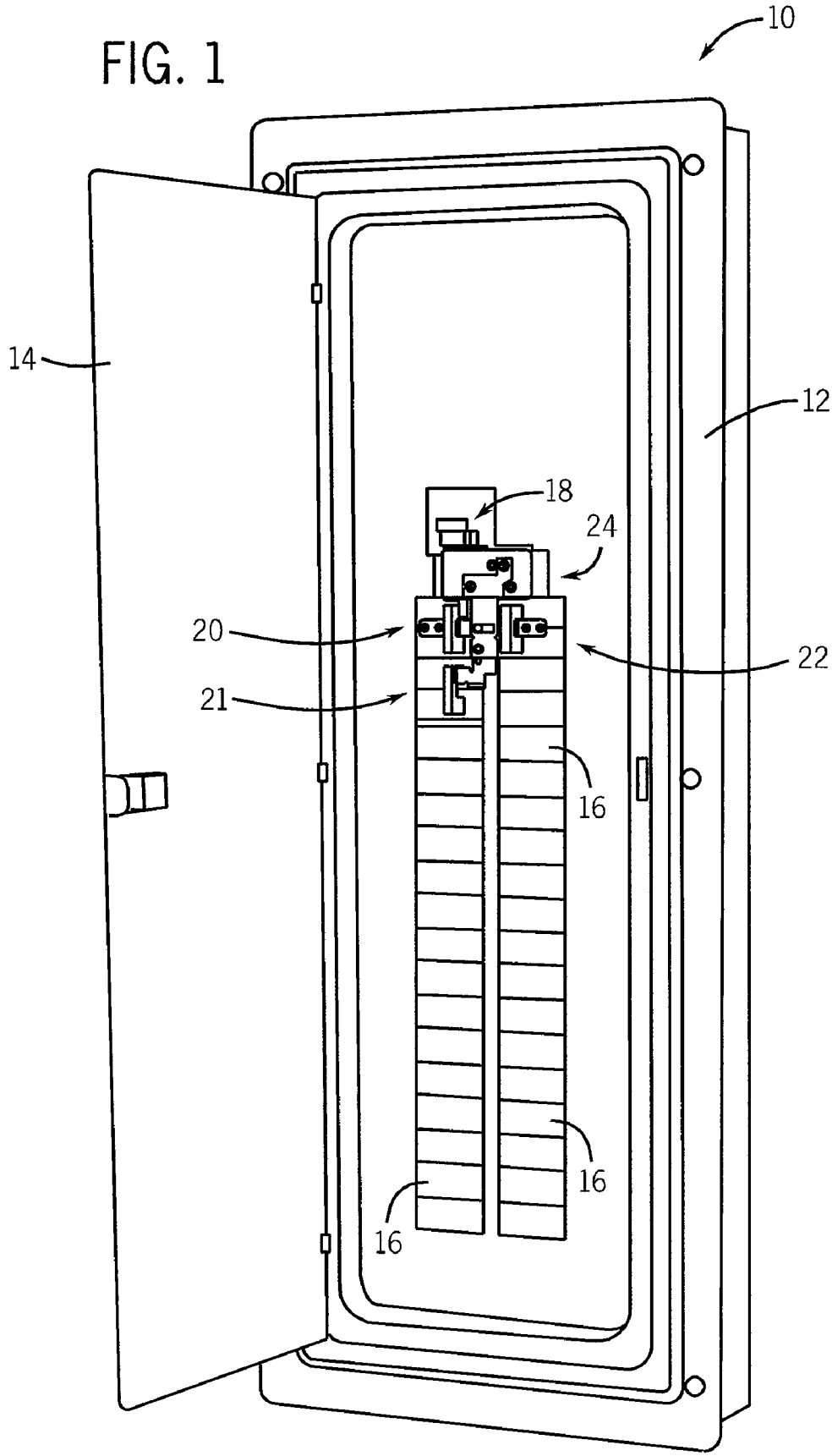
FIG. 1 is a perspective view of an exemplary load center assembly having one embodiment of an interlock assembly according to the present invention.

FIG. 1 shows a load center assembly 10 according to one embodiment of the present invention, which is configured to supply power to a series of electrical circuits from one of at least two power sources. Representatively, load center assembly 10 controls the supply of power to the electrical circuits from a primary power supply, such as utility power, and an alternate or secondary power source which is adapted to supply power in the event power from the primary power supply is unavailable. Typically, the alternate or secondary power source is an electrical generator, although it is understood that any other source of secondary or alternate power may be employed. The following description utilizes terminology which makes reference in various instances to a generator, and it is understood that such terminology is used for the sake the convenience and that the term "generator" is meant to encompass any secondary or alternate power source, and is not limited to a generator as the alternate power source.

Load center assembly 10 includes a cover 12 having a door 14 pivotably connected thereto. Cover 12 includes a series of knockouts 16 constructed to be removed as load breakers are added to load center assembly 10. A main switch 18 passes through cover 12 and is constructed to be connected to a primary power input. A generator neutral switch 20, generator switch 21, and a primary power supply neutral switch 22 are constructed to be electrically connected to load center assembly 10. An interlock assembly 24 is connected to load center assembly 10 and prevents the inadvertent connection of the primary power input via main switch 18 and generator power input via generator switch 21 from being concurrently connected to a the load terminals of load center assembly 10. As will be explained, interlock assembly 24 also controls the movement of neutral switches 20 and 22 relative to main switch 18 and generator switch 21, to ensure that the switches are actuated in the correct sequence.

Figure 2:
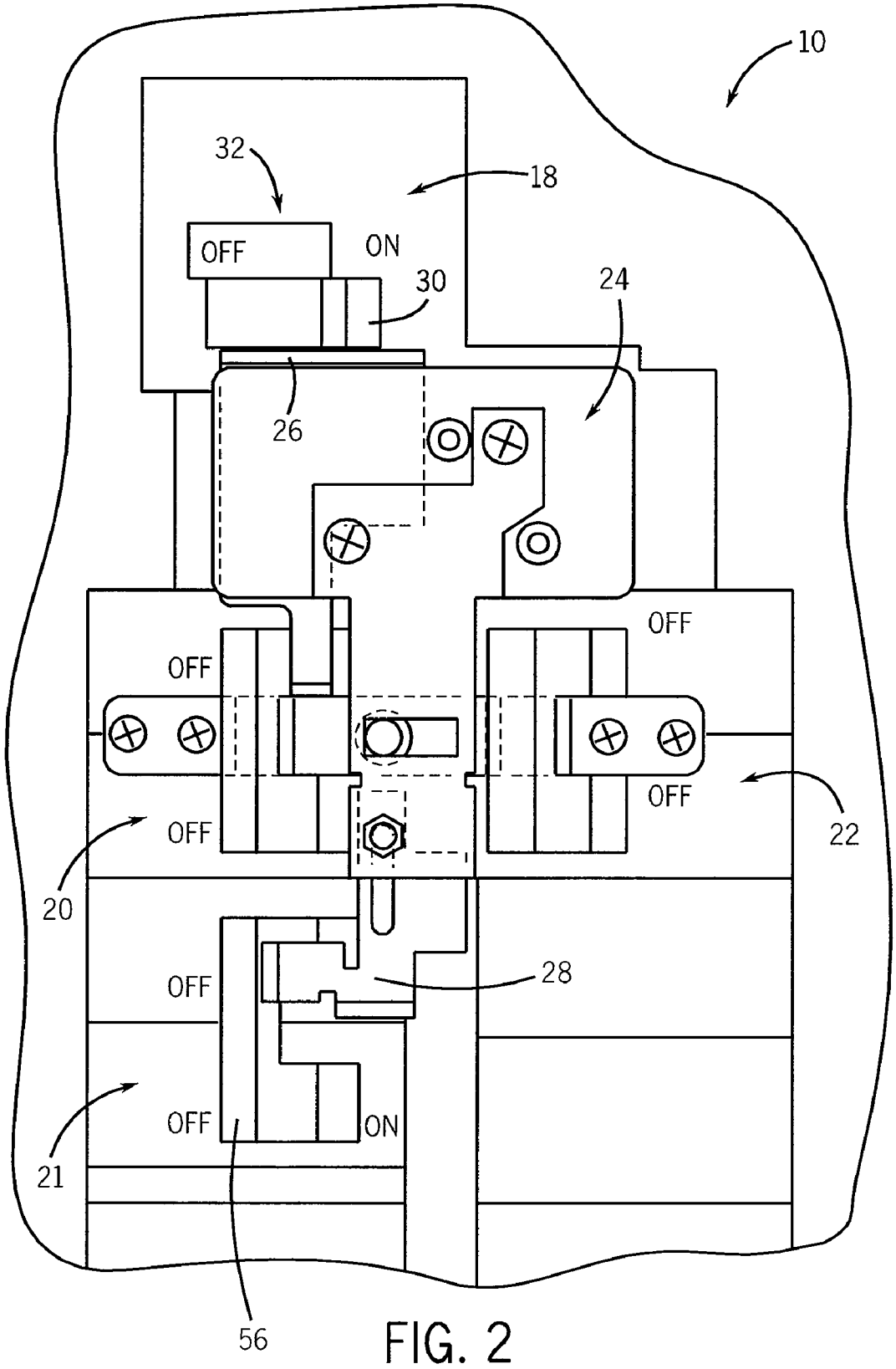
FIG. 2 is an elevational view of the load center assembly shown in FIG. 1 with the interlock assembly configured to enable the supply of primary power to the loads interconnected with the load center assembly.

FIG. 2 shows load center assembly 10 with interlock assembly 24 configured to enable the supply of primary power via main switch 18 such that the loads connected to load center assembly 10 are powered by primary power. Interlock assembly 24 is positioned to prevent the connection of generator power communicated via generator switch 21 to the load terminal bars of load center assembly 10, by preventing movement of generator switch 21 to the ON position. Interlock assembly 24 includes a first movable interlock 26 and a second movable interlock 28, the operation of which are described in FIGS. 2 through 7.

Figure 3:
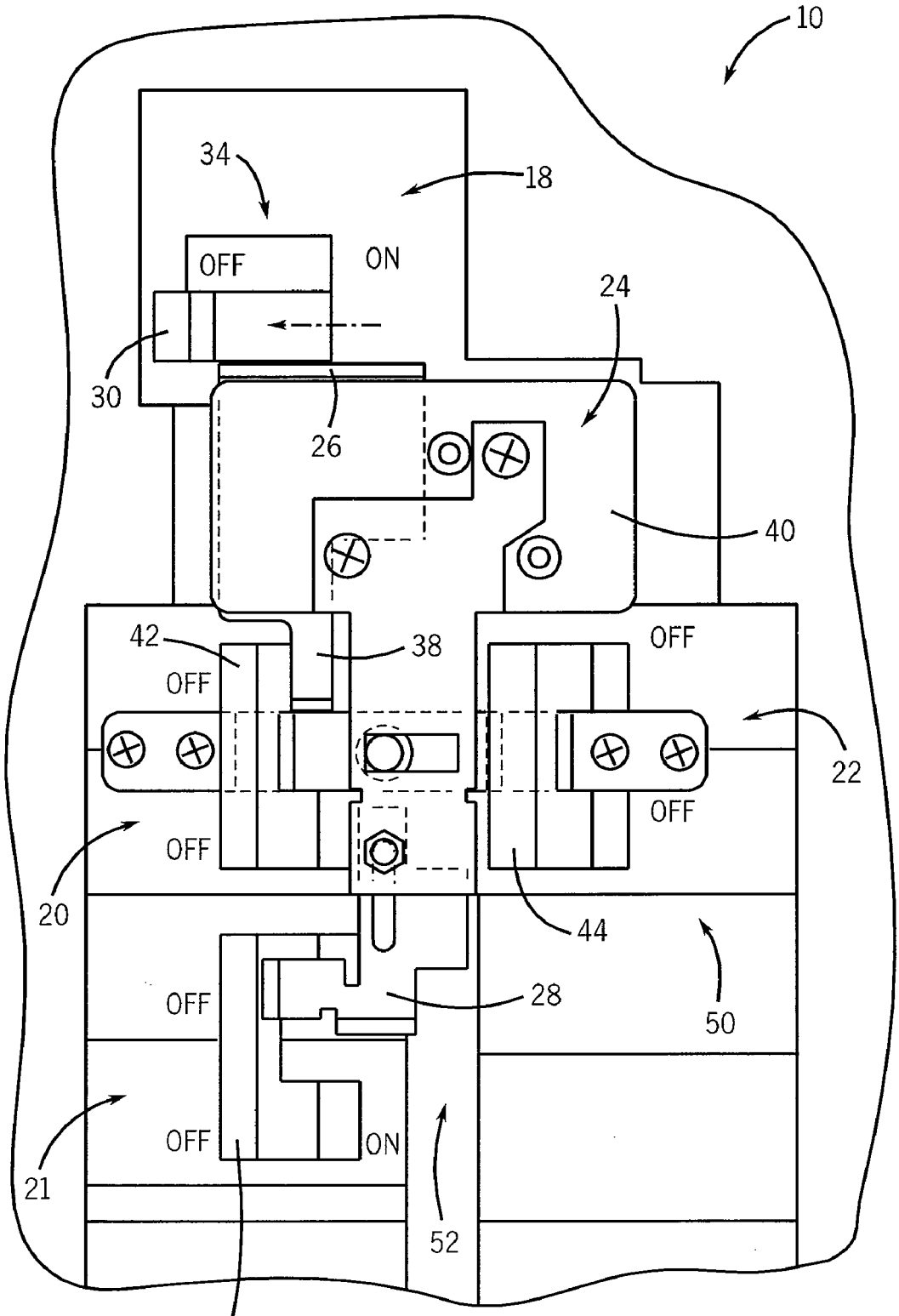
FIG. 3 is an elevational view of the load center assembly shown in FIG. 2 with the primary power and alternate power disconnected from the loads interconnected with the load center assembly.

Referring to FIG. 3, during interruption of primary power, a user translates switch handle 30 of main switch 18 from an ON position 32, as shown in FIG. 2, to the OFF position 34, as shown in FIG. 3. Such manipulation electrically isolates the load terminals and generator switch 21 from primary power conductors connected to main switch 18. With switch 18 positioned in OFF position 34, movable interlock 26 is manually translated upwardly in the direction of arrow 36 (shown in FIG. 4), thereby preventing movement of handle 30 away from the OFF position 34 and locking handle 30 OFF (shown in FIG. 4). A tab 38 of interlock 26 also moves in direction 36 and passes behind an interlock assembly retainer plate 40. Prior to movement of interlock 26 in direction 36, tab 38 extends into the throw of a switch handle 42 of generator neutral switch 20. Accordingly, prior to movement of interlock 26 in direction 36, tab 38 prevents the movement of generator neutral switch 20 away from the generator neutral OFF position. Because generator neutral switch handle 42 and the switch handle 44 of primary power supply neutral switch 22 are interconnected for linear movement together by an inline interlock assembly 46, tab 38 also prevents the movement of primary power supply neutral switch 22 away from the primary neutral ON position.

Figure 4:
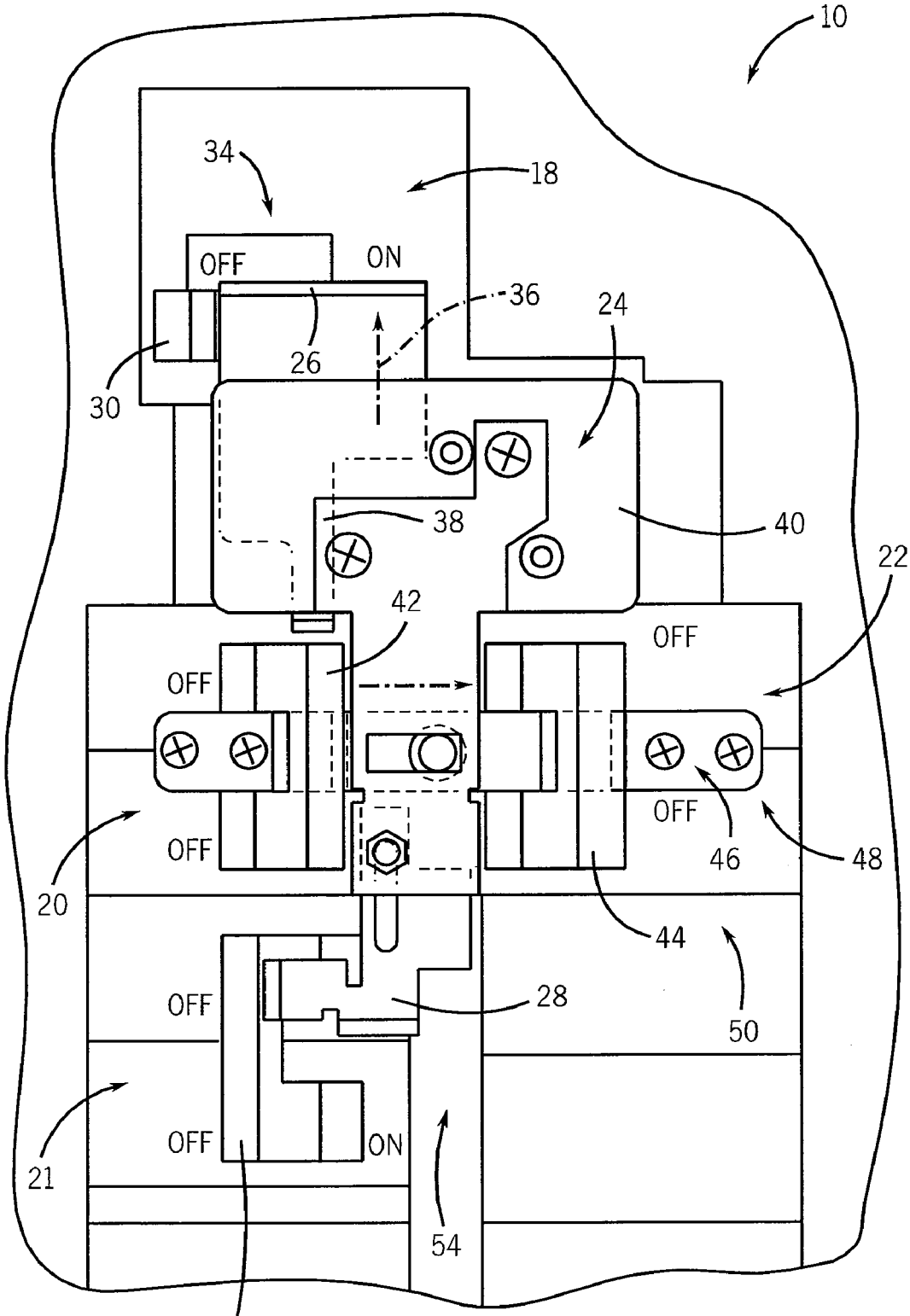
FIG. 4 is an elevational view of the load center assembly shown in FIG. 3 with the interlock assembly configured to enable a pair of neutral switches to switch OFF the primary power supply neutral and switch ON the generator neutral.

As shown in FIG. 4, translation of interlock 26 in direction 36 relative to interlock assembly plate 40 obstructs handle 30 of main switch 18, thereby preventing primary power from being communicated to the load terminal bars of load center assembly 10. At the same time, tab 38 translates in direction 36 behind interlock assembly plate 40 and out of the way of the throw of handle 42 of generator neutral switch 20. Accordingly, when handle 30 of main switch 18 is located in OFF position 34, generator neutral switch 20 can be moved to the ON position by translation of handle 42. Due to the presence of inline interlock assembly 46 between switch handle 42 and switch handle 44 of generator neutral switch 20 and primary power supply neutral switch 22, respectively, generator neutral switch 20 is operable to an ON position and primary power supply neutral switch 22 is moved to an OFF position, represented as position 48 as shown in FIG. 4. This connects the generator neutral to a neutral bar of load center assembly 10 common to switches 20 and 22.

Representatively, inline interlock assembly 46 may have a construction as is shown and described in Flegel U.S. Pat. No. 6,031,193 issued Feb. 29, 2000 or Flegel U.S. Pat. No. 6,927,349 issued Aug. 9, 2005, the disclosures of which are hereby incorporated by reference.

Figure 5:
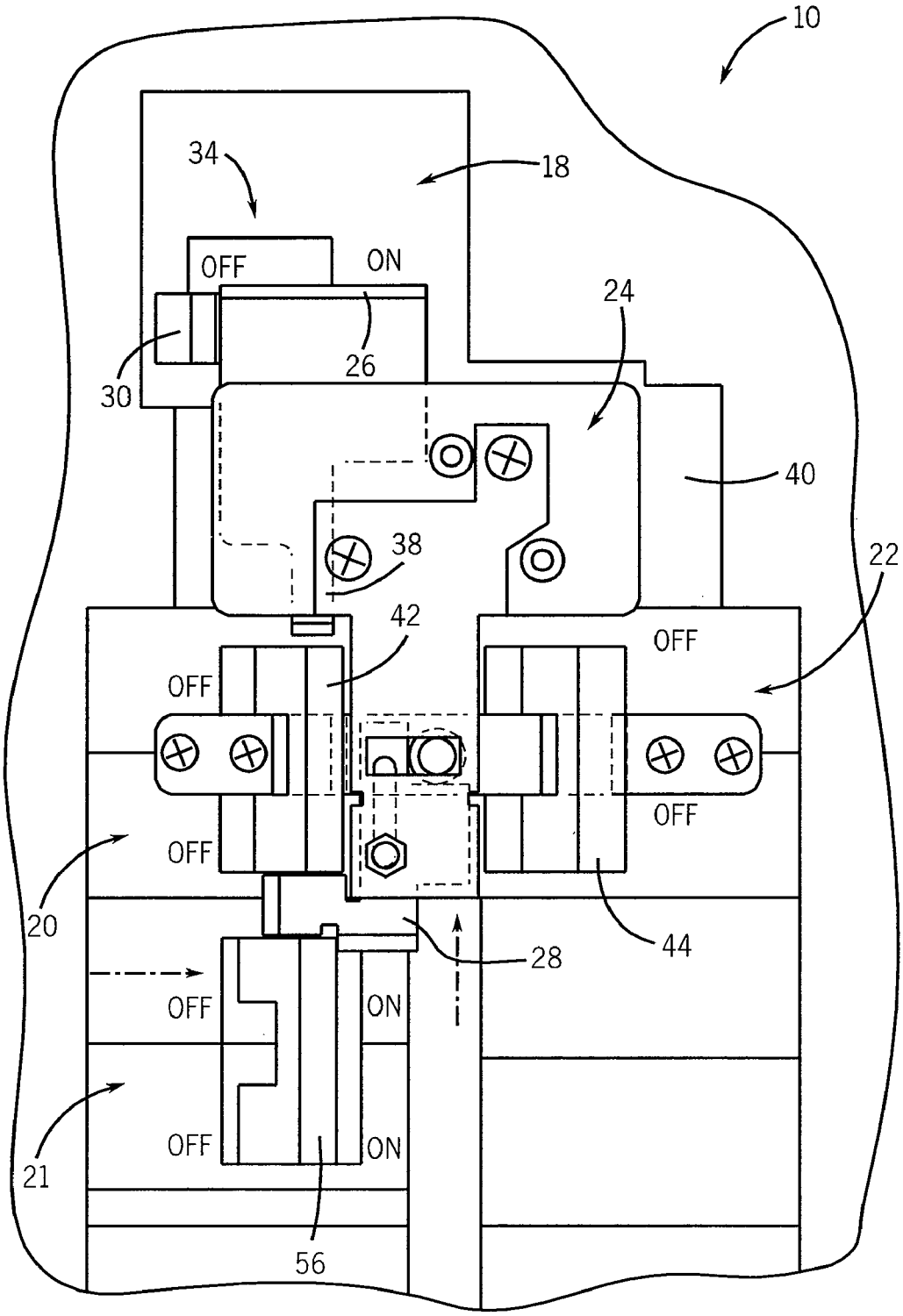
FIG. 5 is an elevational view of the load center assembly of FIG. 4 showing movement of a switch associated with the alternate power input connected to the loads interconnected with the load center assembly.

Referring to FIG. 3 and FIG. 4, second interlock 28 is movable from a first position 52, as shown in FIG. 3, to a second position 54, as shown in FIG. 4, when generator neutral switch handle 42 is in the ON position and primary power supply neutral switch handle 44 is in the OFF position. As shown in FIG. 3, when second interlock 28 is located in first position 52, interlock 28 obstructs the operation of a switch handle 56 of generator switch 21. Also, interlock 28 is prevented from moving by a post 55 of interlock assembly 46. When second interlock 28 is allowed to be moved to second position 54 by the change in position of interlock assembly 46, as shown in FIG. 4, a switch handle 56 of generator switch 21 is operable to connect the generator power input to the input of load center assembly 10. Accordingly, when switch handles 30, 42, 44, and 56 are oriented in the positions as shown in FIG. 5, load center assembly 10 is electrically connected to a generator power input and electrically isolated from a primary power input, and the generator neutral is connected to the neutral of load center assembly 10. Furthermore, interlock assembly 24 prevents the reconfiguration of switches 18, 20, 22, and 21 to such an orientation wherein generator power and primary power are concurrently delivered to the load terminal bars of load center assembly 10. As such, interlock assembly 24 is constructed to sequence the operation of switches 18, 20, 22, and 21 and thereby control and segregate the input power delivered to the load terminal bars of load center assembly 10 relative to the neutral connections of the primary and generator power supplies.

Figure 6:
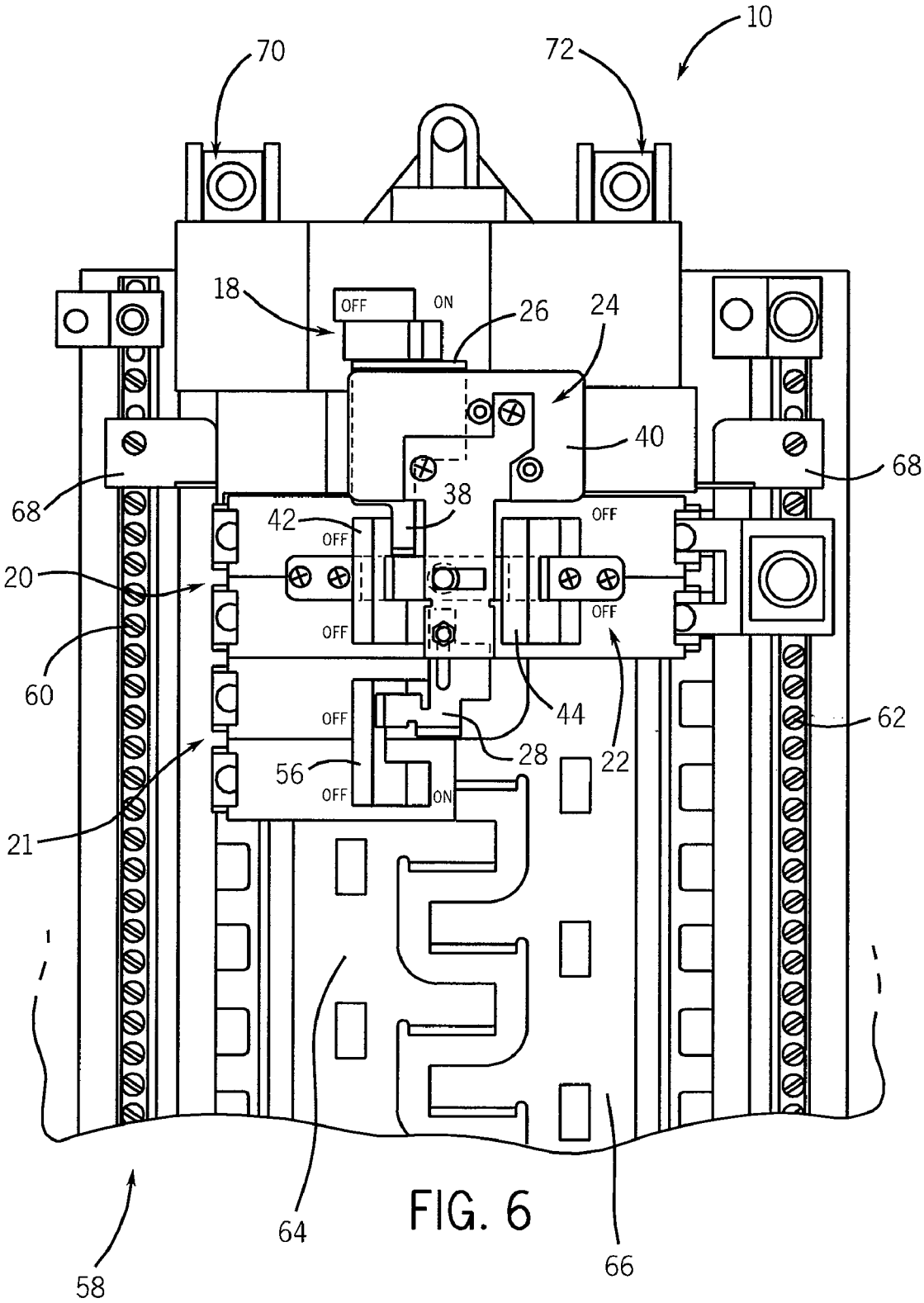
FIG. 6 shows the load center assembly of FIG. 1 with the cover removed therefrom.

As shown in FIG. 6, removal of cover 12 from load center assembly 10 exposes a series of terminal bars 58 located therebehind. Terminal bars 58 include a first and a second neutral bar 60, 62 and a first and a second hot lead terminal bar 64, 66, respectively. A neutral connector plate 68 extends behind interlock assembly 24 and electrically connects first neutral bar 60 and second neutral bar 62. Generator neutral switch 20 is electrically connected to neutral connector plate 68, as is primary power supply neutral switch 22. Generator switch 21 is electrically connected to hot terminal bars 64 and 66.

Figure 7:
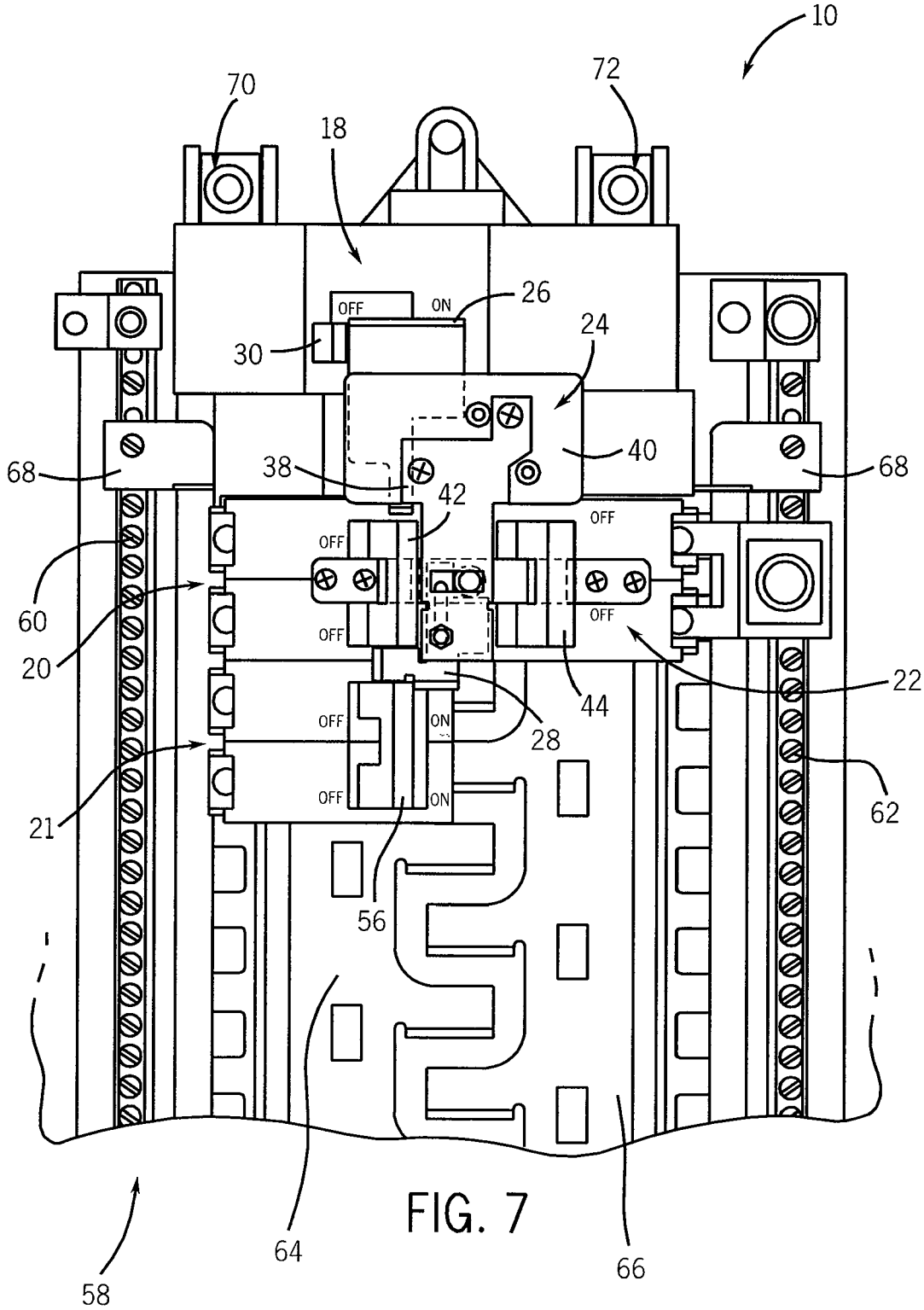
FIG. 7 shows the load center assembly of FIG. 1 with the switches positioned such that primary power is isolated from the load terminal bars and power from the alternate power supply is connected thereto.

Main switch 18 includes a first input terminal 70 and a second input terminal 72 constructed to be electrically connected to a primary power conductor connected to load center assembly 10. When switch handle 30 of main switch 18 is positioned in an ON position, as shown in FIG. 6, primary power communicated to input terminal 70 and input terminal 72 is communicated through main switch 18 to hot terminal bar 64 and hot terminal bar 66, thereby communicating primary power to the load breakers connected to load center assembly 10. Referring to FIG. 7, switch handle 30 of main switch 18 is moved to an OFF position, thereby electrically isolating input terminal 70 and input terminal 72 of main switch 18 from hot terminal bars 64, 66. Movement of first interlock 26 of interlock assembly 24 prevents switch handle 30 from being moved to an ON position and translates tab 38 of interlock assembly 24 such that switch handle 42 of generator neutral switch 20 is free to be moved to an ON position, which also results in movement of switch handle 44 of primary power supply neutral switch 22 to an OFF position. Translation of second interlock 28 relative to interlock assembly 46 allows switch handle 56 of generator switch 21 to be moved to an ON position. In this manner, generator switch 21 is connected to hot terminal bars 64 and 66 and the generator neutral switch 20 is connected to neutral bars 60 and 62 via neutral connector plate 68. Accordingly, when switch handles 30, 42, 44, and 56 are oriented in the positions shown in FIG. 7, generator power is communicated through generator switch 21 to hot terminal bars 64, 66 and generator neutral is communicated through generator neutral switch 20 to neutral plate 68, thereby electrically connecting loads connected to either of first hot terminal bar 64 or second hot terminal bar 66 to the generator-provided input power associated with generator switch 21. This also isolates primary power supply neutral from generator neutral and thus, the neutrals cannot be switched back unless generator and primary supply switches are both OFF. Generator power delivered to load center assembly 10 and communicated to hot terminal bar 64 and hot terminal bar 66 is electrically isolated from primary power supply input terminals 70, 72 of main switch 18. Interlock assembly 24 prevents the concurrent electrical connection of generator switch 21 and main switch 18 with hot terminal bars 64, 66. Such a construction electrically isolates primary power supply input terminals 70 and 72 from hot terminal bars 64, 66 when generator power is supplied, thereby preventing communication of generator-derived power beyond load center assembly 10 via primary power supply conductors connected thereto.

Figure 8:
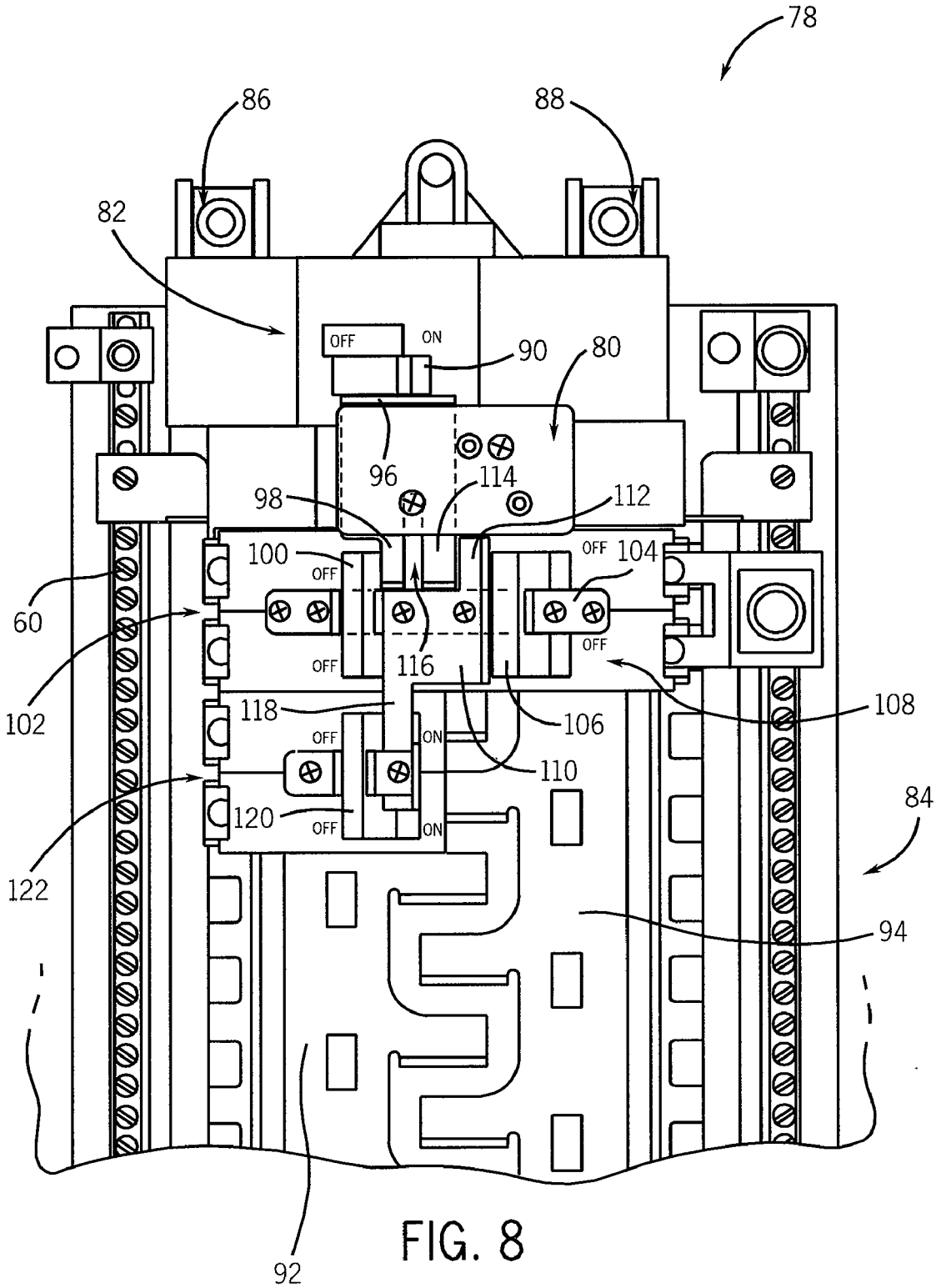
FIG. 8 is an elevational view of a load center assembly equipped with another embodiment of an interlock assembly according to the invention.

FIG. 8 shows another breaker box assembly or load center 78 according to another embodiment of the present invention. Load center 78 includes an alternate embodiment of an interlock assembly 80 according to the present invention. Interlock assembly 80 is disposed between a primary power supply or main switch 82 and a series of switches mounted to load center 78. Main switch 82 includes a first input terminal 86 and a second input terminal 88 constructed to be electrically connected to primary power conductors, respectively. A switch 82 electrically connects input terminals 86, 88 with hot terminal bars 92, 94. Interlock assembly 80 includes a movable interlock 96 that has a tab 98 extending therefrom. Tab 98 extends into a throw of a switch handle 100 of generator neutral switch 102, thereby preventing movement of generator neutral switch handle 100 when tab 98 is so positioned.

An inline interlock assembly 104 extends between generator neutral switch handle 100 and a switch handle 106 of a primary power supply neutral switch 108 such that generator neutral switch handle 100 and primary power supply neutral switch handle 106 are operatively associated such that neither switch can be independently moved. A bracket 110 is connected to connector assembly 104 and disposed between switch handle 100 and switch handle 106. Bracket 110 includes a first extension 112, which interferingly engages another tab 114 of interlock 96. First extension 112 and tab 114 are associated to allow movement of interlock 96 into a space 116 formed between first extension 112 and switch handle 100 of generator neutral switch 102. Such an orientation ensures a snug engagement therebetween, thereby preventing movement of switch handle 100 or switch handle 106 relative to interlock 96 when tabs 98, 114 are disposed in space 116.

Bracket 110 includes a second extension 118, which extends in a direction generally opposite the direction of extension of first extension 112. Second extension 118 is operatively connected to a switch handle 120 of a generator switch 122. Generator switch 122 is electrically connected to hot terminal bars 92, 94. Neutral switches 102 and 108 are electrically connected to neutral bar 60 and 62 via neutral connector plate 68. Accordingly, regardless of which side of load center 78 load circuits are connected, generator power can be utilized to power any desired load connected to load center 78.

Figure 9:
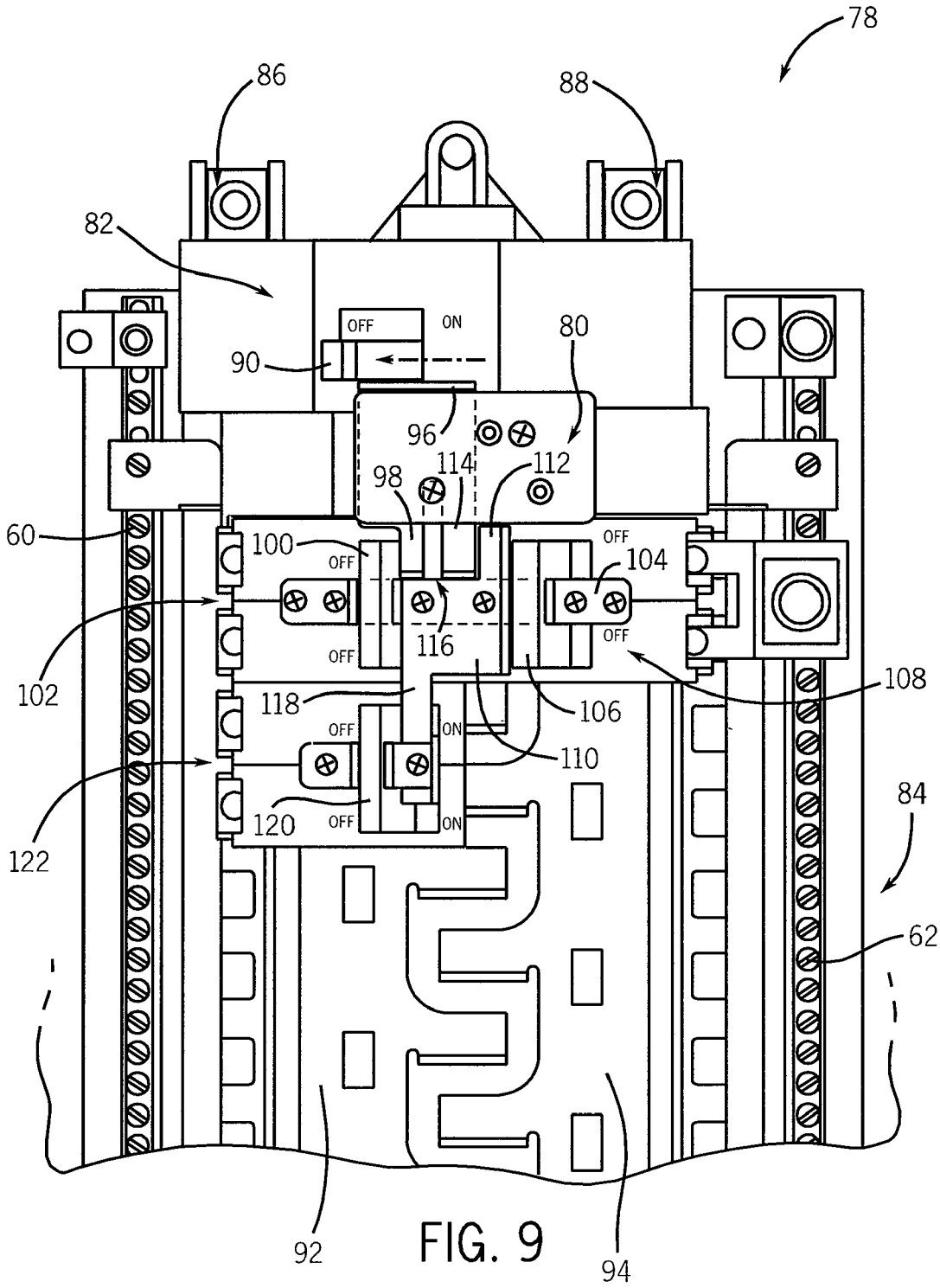
FIG. 9 is an elevational view of the load center assembly shown in FIG. 8 with the switches positioned such that primary power and power from the alternate power supply are both isolated from the load terminal bars and the primary power supply neutral ON and the alternate power supply neutral OFF.

As shown in FIG. 9, switch handle 90 of main switch 82 is located in an OFF position, thereby electrically isolating hot terminal bars 92, 94 from the primary power connected to input terminals 86 and 88 of load center 78. Positioning of switch handle 90 in the OFF position allows interlock 96 to be moved in a direction, indicated by arrow 124 (shown in FIG. 10), toward switch handle 90. As interlock 96 moves in direction 124, tabs 98, 114 translate therewith and out of interfering engagement with switch handles 100, 106 and 120.

Figure 10:
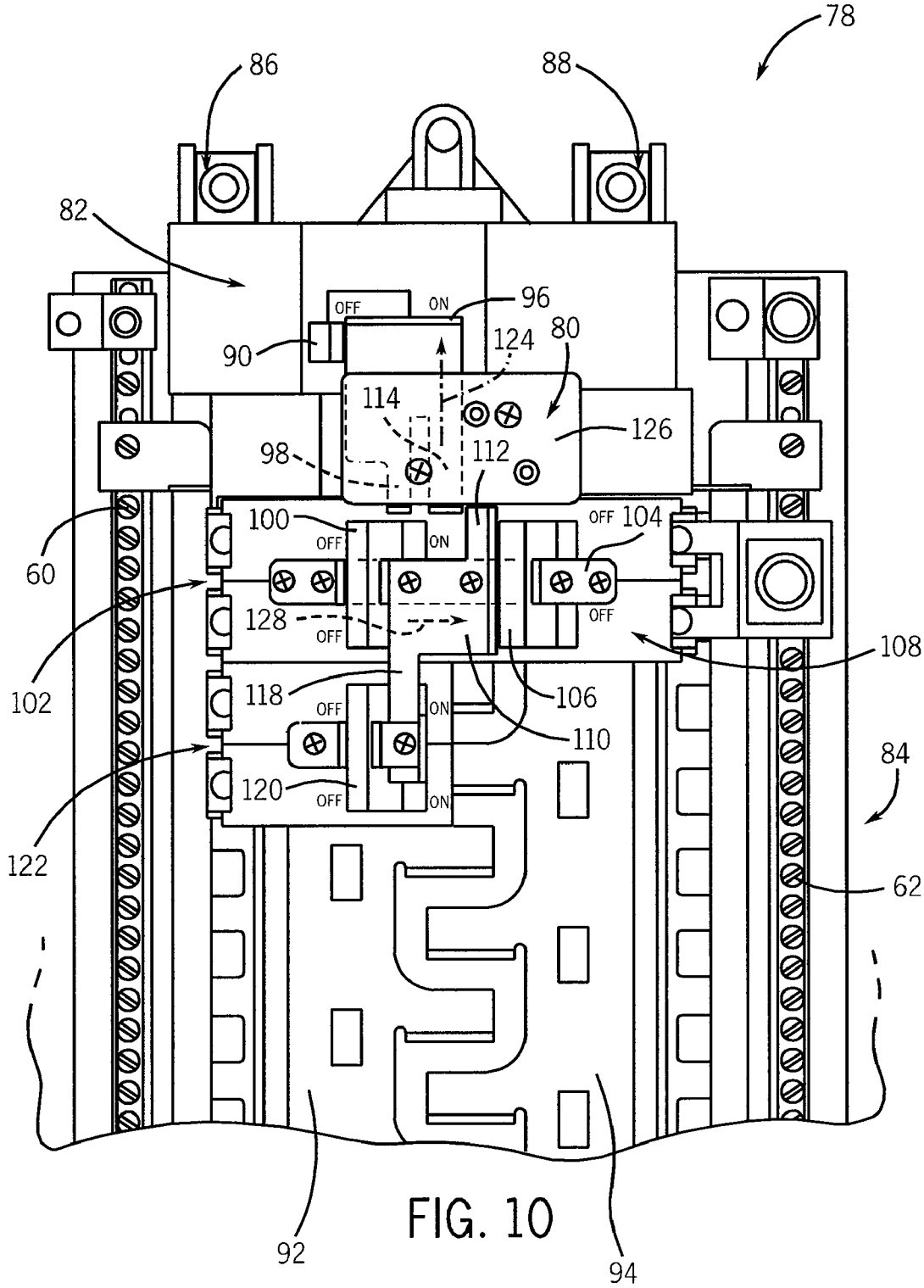
FIG. 10 is an elevational view of the load center assembly shown in FIG. 9 with the switches and interlock assembly configured to prevent connection of primary power to the load terminal bars and allow connection of alternate power thereto.

As shown in FIG. 10, when switch handle 90 is located in an OFF position and interlock 96 is displaced in direction 124, interlock 96 prevents switch handle 90 from being moved to the ON position. Accordingly, when interlock 96 is oriented in the position shown in FIG. 10, switch 82 is configured to electrically isolate the primary power input terminals 86, 88 from hot terminal bars 92, 94, thereby electrically isolating primary power supply conductors connected to inputs 86, 88 from generator power communicated to hot terminal bars 92, 94. Furthermore, as shown in FIG. 10, when interlock 96 is positioned to obstruct handle 90, tabs 98, 114 translate in direction 124 and pass behind a cover plate 126 of interlock assembly 80. Switches handles 100, 106, 120 are interconnected via bracket 110 such that, when interlock 96 is translated in direction 124, as shown in FIG. 10, movement of any of switch handles 100, 106, 120 in a transverse direction, indicated by arrow 128, electrically connects generator input power from generator switch 122 to hot terminal bars 92, 94, respectively, and connects the generator neutral switch 102 to neutral bar 60. The connection of generator switch handle 120 to bracket 110 is positioned such that, as bracket 110 is translated laterally, the primary power supply neutral switch handle 106 is first moved OFF and the generator neutral switch handle 100 is moved ON, before generator switch handle 120 is moved ON. Similarly, the generator switch handle is turned OFF before the generator neutral is switched OFF. This ensures proper sequence of operation of the switches as the supply of power from utility to generator is transferred.

Figure 11:
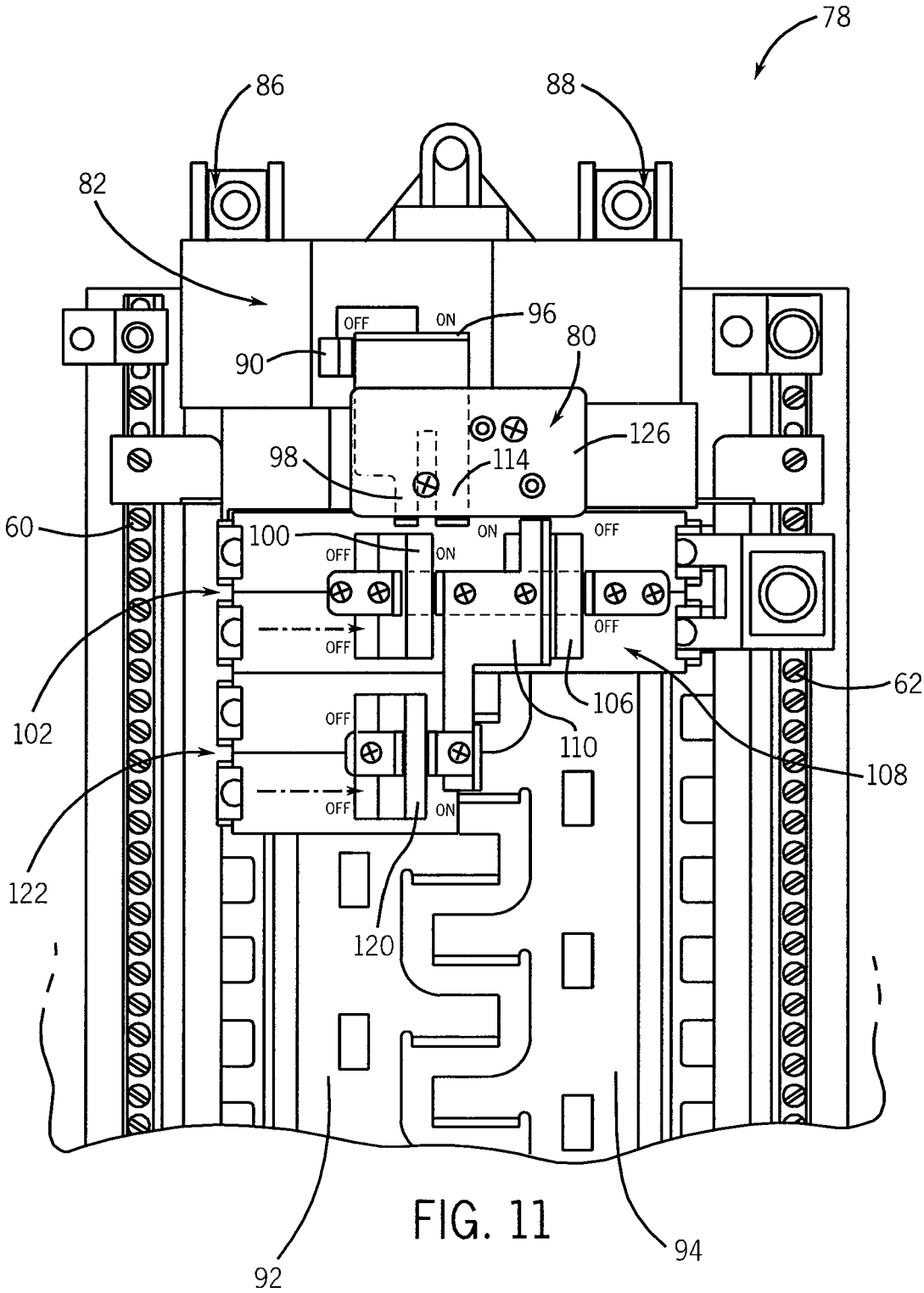

As shown in FIG. 11, bracket 110 has been translated in direction 128, thereby moving switch handles 100, 106, 120 to an ON position, and electrically connecting generator power communicated to generator switch 122 to hot terminal bars 92, 94 and connecting generator neutral switch 102 to neutral bars 60, 62. Furthermore, when generator power is communicated through generator switches 122 to hot terminal bars 92, 94, movable interlock 96 of interlock assembly 80 prevents the electrical connection of primary power supply power input terminals 86, 88 of primary power supply switch 82 with hot terminal bars 92, 94, thereby electrically isolating input terminals 86 and 88 from power communicated to load center 78 via the primary power source. Understandably, to convert load center 78 from primary power supply-derived power to generator-derived power, a user must simply orient handle 90 of main switch 82 in the OFF position, translate interlock 96 in direction 124, and translate switch handles 100 and 120 to an ON position, thereby electrically connecting the generator-type power to hot terminal bars 92, 94 and the neutral to neutral bars 60, 62. Such a configuration allows a user to conveniently and expeditiously configure load center 78 to power desired loads from a desired input power supply.

Figure 12:
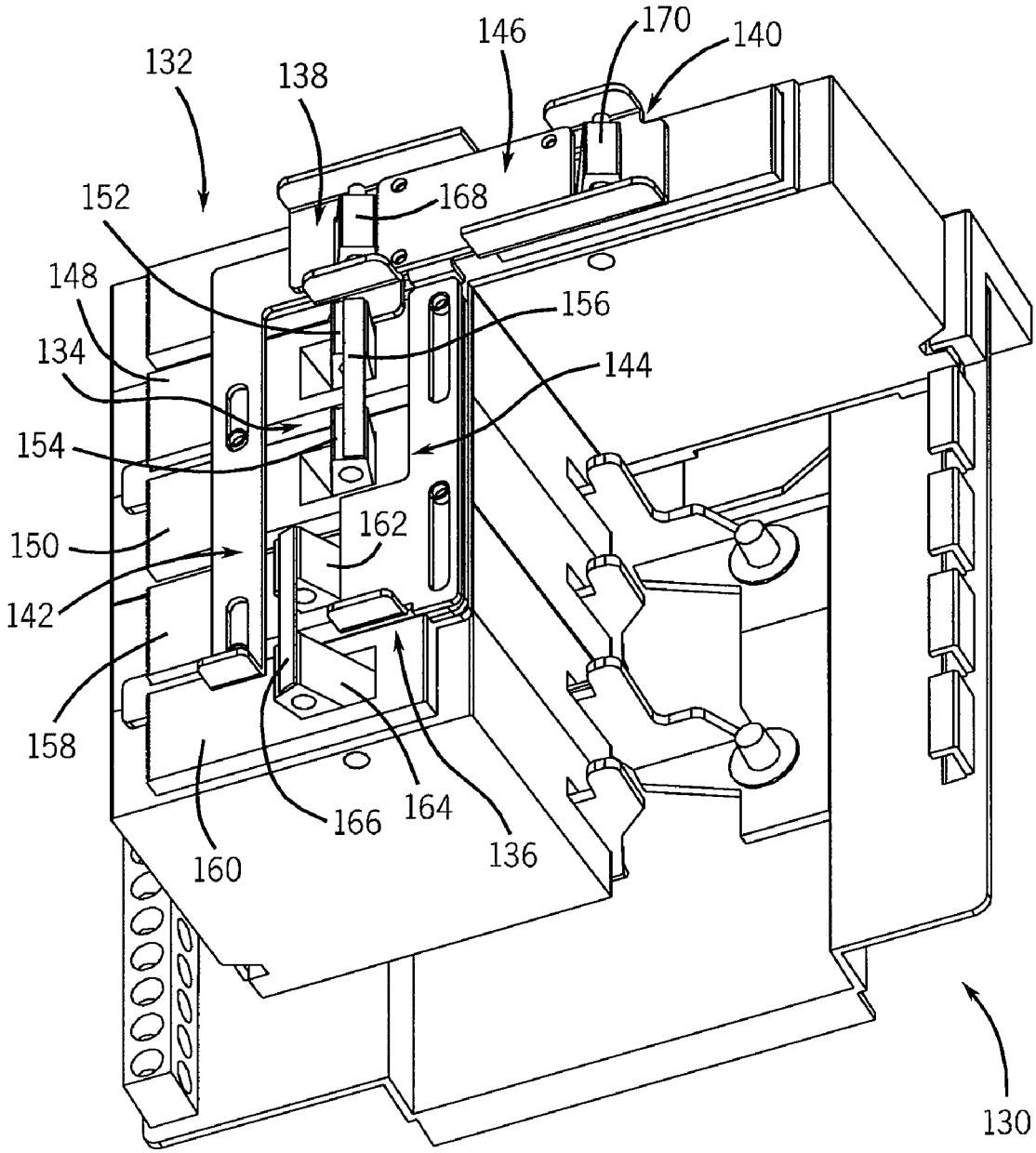
FIG. 12 is an isometric view of an interlock assembly for use with a transfer switch designed to control connection of a load center to a primary power supply and an alternate power supply according to another embodiment of the invention.
Figure 13:
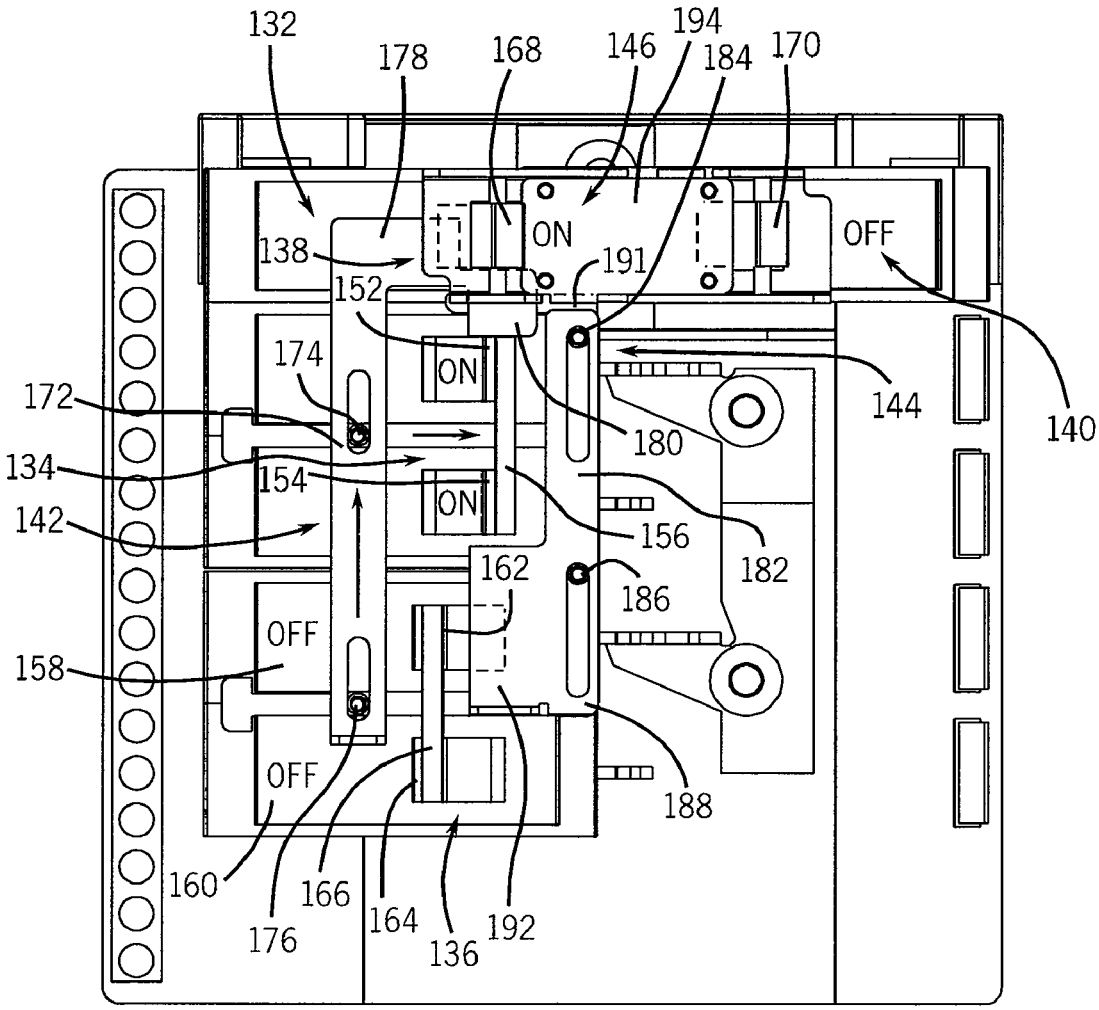
FIG. 13 is an elevation view of the interlock assembly of FIG. 12 positioned such that primary power may be communicated to the load center.

FIGS. 12-16 illustrate an interlock assembly according to another embodiment of the invention. Like the interlock assembly described with respect to FIGS. 1-11, interlock assembly is designed to prevent a load center assembly from being electrically connected to receive power from two power supplies simultaneously. FIGS. 12-13 show a portion of a load center assembly 130 with interlock assembly 132 configured to enable the supply of primary power via primary power supply switch 134 such that the loads of the load center assembly 130 are powered by primary power. Interlock assembly 132 is positioned to prevent the connection of generator power communicated via generator switch 136 to the load center assembly 130, by preventing movement of generator switch 136 to the ON position. The interlock assembly 132 also interfaces with primary power supply neutral switch 138 and alternate power neutral switch 140 to prevent both switches 138, 140 from being in the ON position simultaneously. The neutral switches 138, 140 are aligned with one another with a switch being in the ON position when thrown toward the other switch. Thus, in FIGS. 12-13, the primary power supply neutral switch 138 is in the ON position and the alternate power neutral switch 140 in the OFF position. As will be described more fully below, the interlock assembly 132 includes a first movable interlock 142, a second movable interlock 144, and an inline neutral interlock 146.

The primary power supply switch 134 is comprised of a pair of breakers 148, 150, each having switch handles 152, 154, respectively, that are tied together in a known manner by member 156. Similarly, the alternate power switch 136 is comprised of a pair of breakers 158, 160, each having switch handles 162, 164, respectively, that are tied together in a known manner by member 166. Neutral switches 138 and 140 similarly include respective switch handles 168 and 170. FIG. 12 shows the arrangement of the interlock assembly 132 as well as the switches 134, 136, 138, and 140 when the load center is operative to receive power from the primary power supply, e.g., utility grid, and is electrically isolated from the alternate power supply, e.g., electric generator.

Interlock 142 has a generally planar and slotted body 172 designed to slide along pins 174, 176. The body 172 has an upper portion 178 from which a leg member 180 downwardly extends. As shown in FIG. 13, the leg 180 is spaced from the slotted body 172. The upper portion 178 as well as the leg 180 sit beneath a portion of the inline interlock 146. Interlock 144 also has a planar and slotted body 182 that is designed to slide along pins 184, 186. The body 182 has a lower portion 188 from which a leg 192 axially extends and an upper portion 191. As will be described more fully below, when the body 182 is slid fully upward, a portion of the body 182 will slide beneath the inline interlock 146. The inline interlock 146 is generally comprised of a plate 194 that abuts against both switch handles 168 and 170, and is designed to slide with movement of the switch handles 168, 170. Interlocks 142 and 144 slide independently of one another but along generally parallel axes.

Figure 14:
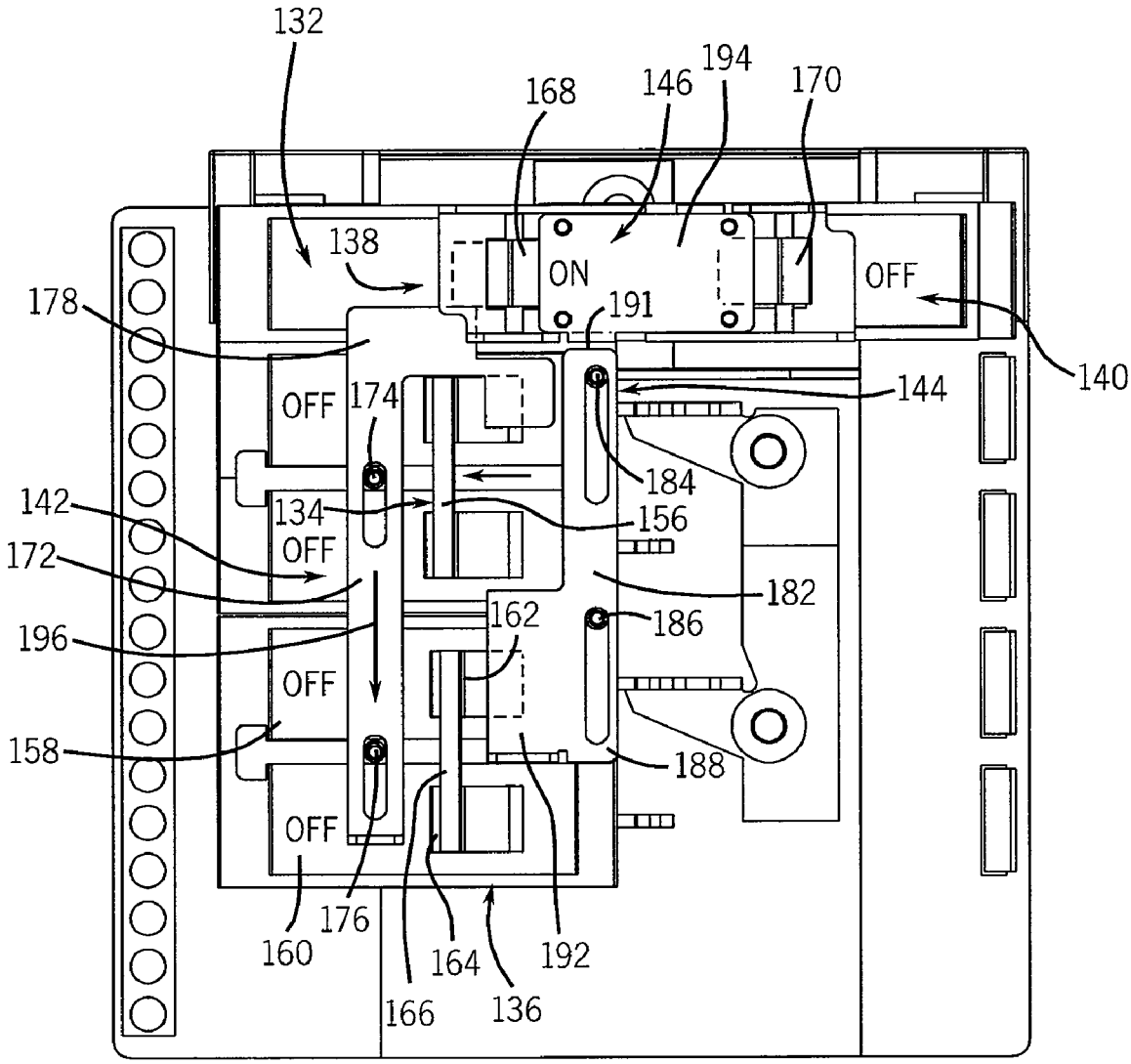
FIG. 14 is an elevation view of the interlock assembly of FIG. 12 positioned such that the primary power supply and the alternate power supply are both isolated from the load center.

During interruption of primary power, a user translates switch handles 152, 154 of switch 134 from an ON position, as shown in FIG. 13, to the OFF position, as shown in FIG. 14. With switch 134 positioned in the OFF position, movable interlock 142 is manually translated downward in the direction of arrow 196 (shown in FIG. 14). Leg 180 of interlock 142 thereby moves in direction 196 and passes behind switch handle 152. Prior to movement of interlock 142 in direction 196, upper portion 178 extends into the throw of switch handle 168 of primary power supply neutral switch 138. Accordingly, prior to movement of interlock 142 in direction 196, upper portion 178 prevents the movement of primary power supply neutral switch 138 away from the ON position. Because primary power supply neutral switch handle 168 and the switch handle 170 of alternate power neutral switch 140 are interconnected for linear movement together by the inline interlock 146, upper portion 178 also prevents the movement of alternate power neutral switch 140 toward the alternate power neutral ON position. As shown in FIG. 13-14, when the primary power supply neutral switch 138 is in the ON position, the inline interlock 146 blocks upward movement of the movable interlock 144. It will also be appreciated that the primary and alternate power switches can both be OFF but cannot both be ON at the same time.

Figure 15:
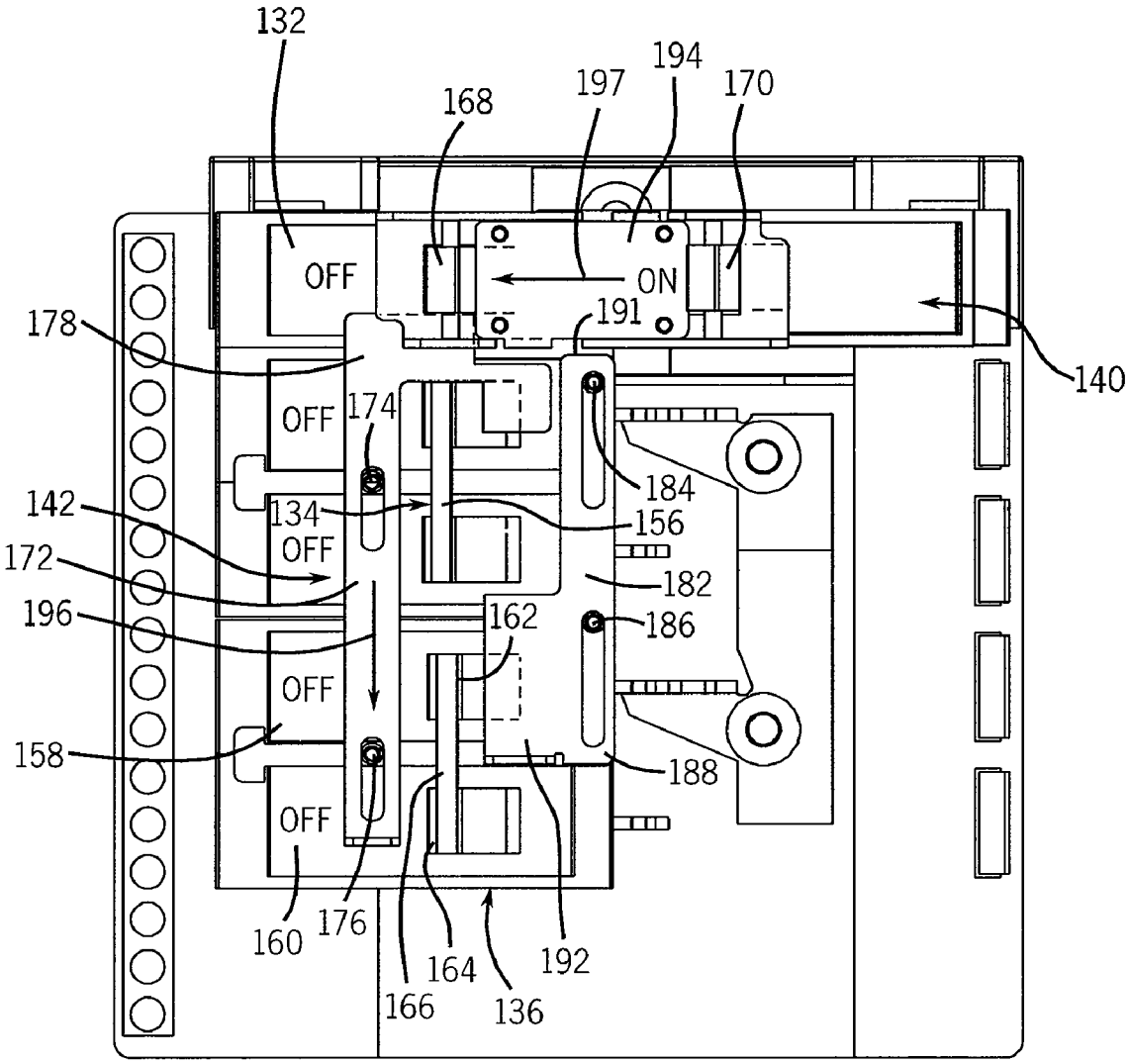
FIG. 15 is an elevation view of the interlock assembly of FIG. 12 positioned such that a primary power supply neutral switch is in the OFF position and an alternate power supply neutral switch is in the ON position.

Referring now to FIG. 15, when the interlock 142 is moved downward in direction 196, the upper portion 178 of the interlock 142 is cleared from blocking movement of switch handle 168 of the primary power supply neutral switch 138. In this regard, the neutral switch 138 can only be moved to its OFF position after the primary power supply switch 134 has been moved to its OFF position. Additionally, because the neutral switches 138, 140 are linked together by inline interlock 146, the alternate power neutral switch 140 is automatically moved in direction 197 to its ON position when the primary power supply neutral switch 138 is moved to its OFF position. Preferably, switch 138 reaches its OFF position before switch 140 reaches its ON position, such as described in U.S. Pat. No. 6,031,193 or U.S. Pat. No. 6,927,349, the disclosures of which are hereby incorporated by reference.

Figure 16:
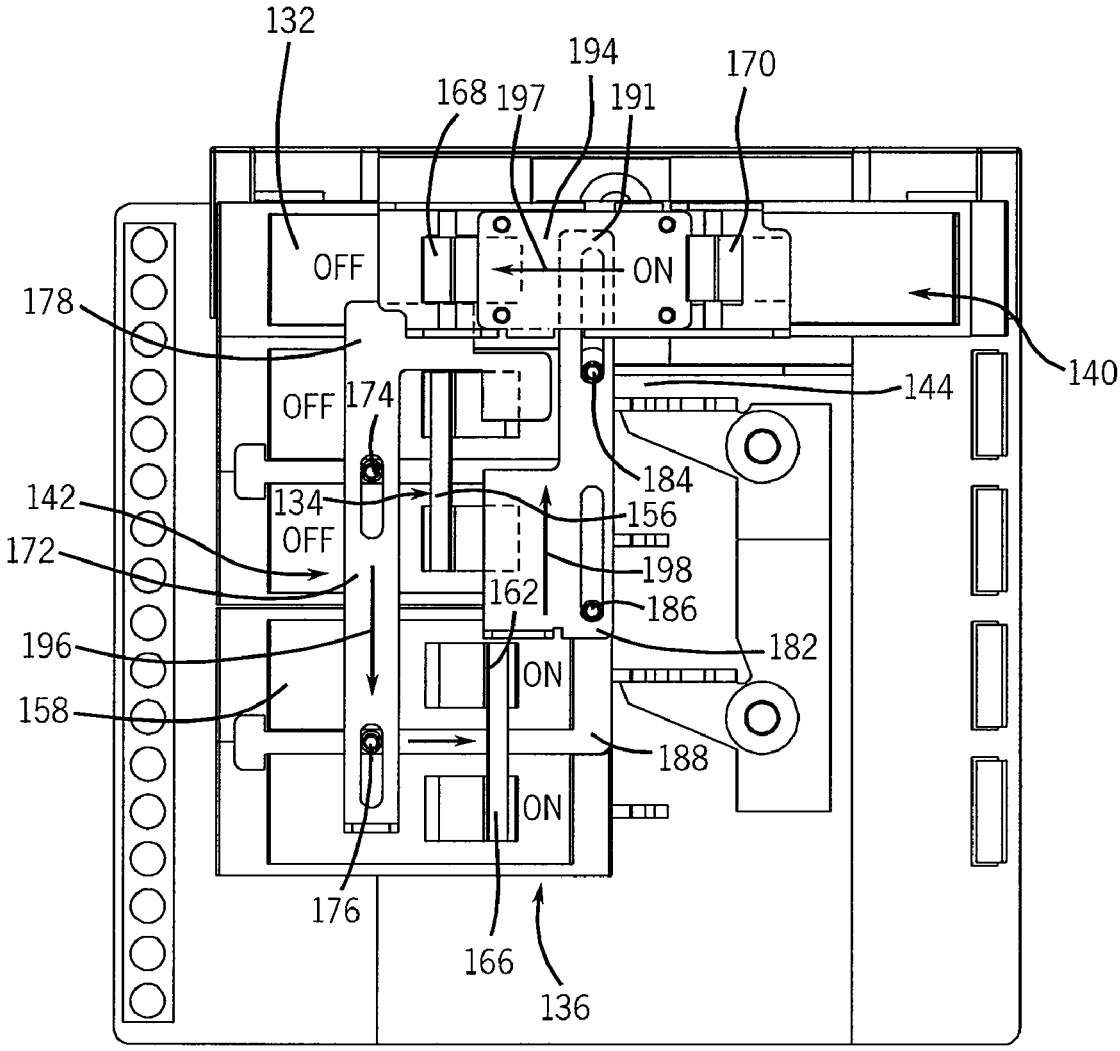
FIG. 16 is an elevation view of the interlock assembly of FIG. 12 positioned such that alternate power may be communicated to the load center.

When the primary power supply neutral switch 138 is thrown to its OFF position, the plate 194 of the inline interlock follows that movement and, in effect, moves to a position whereby upward movement of the interlock 144 is no longer blocked by the inline interlock 146, as illustrated in FIG. 15. Thus, when the switch handles 152, 154 are thrown to the OFF position and the primary power supply neutral switch 138 is moved to the OFF position, interlock 144 may be slid upwardly in direction 198 along pins 184, 186 to clear alternate power switch 136 as shown in FIG. 16. As also illustrated in FIG. 16, the upper portion 191 slides beneath the inline interlock 146 to free switch 136. In this position, interlock 144 prevents the inline interlock 146 from sliding and thus prevents the neutral switches 138, 140 from changing position and also blocks the primary power supply switch 134 from being switched ON.

When the interlock 144 is slid upward in the direction represented by arrow 198, the switch handles 162, 164 of switch 136 may be thrown from the OFF position to the ON position. As a result, the load center assembly is now electrically isolated from the primary power supply and is connected to receive power from the alternate power supply. When primary power is restored, the switch sequence described above, is reversed to disconnect the load center assembly from the alternate power supply and connect it to the primary power supply.

It will thus be appreciated that the present invention provides an interlock assembly that sequences disconnection of the load center from a primary power supply and connection to an alternate power supply in a controlled manner to prevent the load center assembly from being electrically connected to both power supplies simultaneously.

It will also be appreciated that the inline interlock 146 described herein is designed to move the neutral switches 138, 140 in tandem such that one of the switches is always in the OFF position and the other one of the switches is always in the ON position. However, it is understood that the inline interlock could be constructed such that both neutral switches cannot be in the ON position at the same time, but that both neutral switches could be in the OFF position at the same time. Such an inline interlock is described in U.S. Ser. No. 12/509,779, the disclosure of which is incorporated herein.

Various alternatives are contemplated as being within the scope of the following claims particularly pointing out and distinctly claiming the subject matter regarded as the invention.

What is claimed is:

1. An electrical interlock assembly for controlling the supply of electrical power from a primary power supply and an alternate power supply, comprising:

a mounting arrangement constructed to be fixed relative to a primary power switch and a power switch associated with an alternate power supply; and an interlock arrangement movably connected to the mounting arrangement and constructed to allow operation of one switch, either the primary power switch or the alternate power supply switch, while preventing the operation of the other switch, and wherein the interlock arrangement includes a neutral interlock slidable along a first axis for selectively enabling movement of two neutral switches, one neutral switch interconnected with the alternate power supply and another neutral switch interconnected with the primary power supply and further includes a first interlock slidable along a second axis perpendicular to the first axis and between a first position and a second position, and wherein the first interlock prevents movement of the two neutral switches when in the first position and permits movement of the two neutral switches when in the second position.

2. The electrical interlock assembly of claim 1 wherein the first interlock prevents the primary power switch from being thrown when in the second position.

3. The electrical interlock assembly of claim 1 wherein the interlock arrangement further includes a second interlock slidable along a third axis that is parallel to the second axis, and wherein the second interlock is moved between a third position and a fourth position, and wherein the second interlock prevents the alternate power supply switch from being thrown when in the third position.

4. The electrical interlock assembly of claim 3 wherein the second interlock permits the alternate power supply switch to be thrown when in the fourth position and prevents movement of the two neutral switches when in the fourth position.

5. The electrical interlock assembly of claim 4 wherein the second interlock further prevents the primary power switch from being thrown when in the fourth position.

6. The electrical interlock assembly of claim 1 wherein the neutral interlock comprises an inline interlock that moves the neutral switches in tandem and the primary power switch includes a first switch member and a second switch member tied to the first switch member such that the first switch member and the second switch member switch in unison.

7. The electrical interlock assembly of claim 1 wherein the neutral interlock is configured such that connection of a load center from the primary power supply to the alternate power supply follows the following sequence:

(a) disconnection of the load center from a hot conductor of the primary power supply;

(b) disconnection of the load center from a neutral conductor of the primary power supply;

(c) connection of the load center to a neutral conductor of the alternate power supply; and (d) connection of the load center to a hot conductor of the alternate power supply.

8. The electrical interlock assembly of claim 7 wherein the neutral interlock is configured to ensure that reconnection of the load center from the alternate power supply to the primary power supply follows the following sequence:

(a) disconnection of the load center from the hot conductor of the alternate power supply;

(b) disconnection of the load center from the neutral conductor of the alternate power supply;

(c) connection of the load center to the neutral conductor of the primary power supply; and (d) connection of the load center to the hot conductor of the primary power supply.

9. An electrical load center comprising:

a primary switch electrically connected between a primary power supply and a power distribution member;

an alternate power supply switch connected between an alternate power supply and the power distribution member;

a first neutral switch connected between the alternate power supply and a neutral conductor;

a second neutral switch connected between the primary power supply and a neutral conductor; and an interlock arrangement constructed to prevent electrical connectivity through the primary switch and the alternate power supply switch, wherein the interlock arrangement is comprised of a neutral interlock that causes the first neutral switch and the second neutral switch to switch as a single unit such that at the end of a switching iteration one neutral switch is in a conductive position while the other neutral switch is not in a conductive position, and is further comprised of a first interlock constructed to block movement of the neutral interlock when the alternate power supply switch is in a conductive position.

10. The electrical load center of claim 9, wherein the neutral interlock is an inline interlock operable between the first neutral switch and the second neutral switch, and further includes a second interlock operable to permit movement of the neutral interlock only when the main switch is a non-conductive position.

11. The electrical load center of claim 10 wherein the first interlock is movable between a first position and a second position, wherein when in the first position, the first interlock allows the neutral interlock to move and prevents the alternate power supply switch from being thrown.

12. The electrical load center of claim 10 wherein the first interlock and the second interlock move along a first axis and a second axis, respectively, that are parallel to one another and the neutral interlock moves along a third axis perpendicular to the first and second axes.

13. The electrical load center of claim 10, wherein the second interlock is movable between a first position and a second position, wherein when in the first position, the second interlock permits movement of the primary switch and when in the second position, the second interlock prevents movement of the primary switch.

14. The electrical load center of claim 13 wherein the first interlock is movable between a first position and a second position, wherein when the first interlock is in the first position the alternate power supply switch cannot be moved and when the first interlock is in the second position the primary switch cannot be moved, and wherein the first interlock is movable to the first position only when the second interlock is in the second position.

15. An interlock system for a power management system that controls power to a load center normally powered by a primary power supply and powered by an alternate power supply during interruption of the primary power supply, wherein current to the load center from the primary power supply is fed through a main switch and wherein current to the load center from the alternate power supply is fed through an alternate power supply switch, wherein the main switch, the alternate power supply switch and one of the neutral switches are vertically aligned with one another, the interlock system comprising:

an inline interlock operable between the first neutral switch and the second neutral switch;

a first interlock operable to selectively prevent switching of the main switch; and a second interlock operable to selectively prevent switching of the alternate power supply switch.

16. The interlock system of claim 15 wherein the first and second interlock are movable along parallel axes and the inline interlock is movable along an axis perpendicular to the parallel axes.

* * * * *